US011282634B2

(12) United States Patent
Kim et al.

(10) Patent No.: US 11,282,634 B2
(45) Date of Patent: Mar. 22, 2022

(54) COIL ELECTRONIC COMPONENT

(71) Applicant: SAMSUNG ELECTRO-MECHANICS CO., LTD., Suwon-si (KR)

(72) Inventors: Young Sun Kim, Suwon-si (KR); Kwang Il Park, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 560 days.

(21) Appl. No.: 16/050,688

(22) Filed: Jul. 31, 2018

(65) Prior Publication Data

US 2019/0189336 A1 Jun. 20, 2019

(30) Foreign Application Priority Data

Dec. 20, 2017 (KR) ..... 10-2017-0175842

(51) Int. Cl.
*H01F 27/28* (2006.01)
*H01F 27/32* (2006.01)
*H01F 17/00* (2006.01)

(52) U.S. Cl.
CPC ..... *H01F 27/2828* (2013.01); *H01F 17/0013* (2013.01); *H01F 27/2885* (2013.01); *H01F 27/32* (2013.01)

(58) Field of Classification Search
CPC ..... H01F 27/2804; H01F 27/2828; H01F 27/2885; H01F 27/292; H01F 27/32; H01F 27/323; H01F 17/0006; H01F 17/0013; H01F 17/04; H01F 2017/002; H01F 2017/048; H01F 2027/2809; H01F 2027/2819
USPC ..... 336/200, 232
See application file for complete search history.

(56) References Cited

U.S. PATENT DOCUMENTS 5,515,022 A * 5/1996 Tashiro ..... H01F 17/0013 174/262
2009/0243781 A1* 10/2009 Nomura ..... H01F 17/0013 336/200
2011/0254650 A1* 10/2011 Banno ..... H01F 17/0013 336/200
2015/0035634 A1* 2/2015 Nakamura ..... H01F 41/046 336/170
2015/0102891 A1 4/2015 Yoon et al.
(Continued)

FOREIGN PATENT DOCUMENTS

JP 10241983 A * 9/1998
JP H11-204337 A 7/1999
(Continued)

*Primary Examiner* — Tszfung J Chan
(74) *Attorney, Agent, or Firm* — Morgan, Lewis & Bockius LLP

(57) ABSTRACT

A coil electronic component includes a body and external electrodes disposed on an external surface of the body. The body includes a support member including a through-hole, upper and lower coils supported by the support member and including a plurality of coil patterns, a via connecting the upper and lower coils to each other, and an insulating wall supported by the support member and insulating adjacent coil patterns from each other. The via is formed on at least a portion of a interface of the through-hole.

19 Claims, 3 Drawing Sheets

(56) References Cited

U.S. PATENT DOCUMENTS

| | | | | |
|---|---|---|---|---|
| 2016/0078995 | A1* | 3/2016 | Yoon | H01F 27/292 336/192 |
| 2016/0111194 | A1* | 4/2016 | Jeong | H01F 27/292 336/200 |
| 2016/0163444 | A1* | 6/2016 | Choi | H01F 17/04 336/200 |
| 2016/0189840 | A1* | 6/2016 | Ahn | H01F 17/0013 336/192 |
| 2016/0293320 | A1* | 10/2016 | Kim | H01F 17/0013 |
| 2016/0307689 | A1* | 10/2016 | Jeong | H01F 17/0013 |
| 2017/0287621 | A1* | 10/2017 | Seino | H01F 1/28 |
| 2018/0218830 | A1* | 8/2018 | Nakanishi | H01F 27/2852 |

FOREIGN PATENT DOCUMENTS

| | | | | | |
|---|---|---|---|---|---|
| JP | 2001203109 | A | * | 7/2001 | |
| JP | 2004319570 | A | * | 11/2004 | |
| JP | 2006278909 | A | * | 10/2006 | |
| JP | 2006310716 | A | * | 11/2006 | |
| JP | 2015-032625 | A | | 2/2015 | |
| JP | 2017017142 | A | * | 1/2017 | |
| KR | 10-2015-0044372 | A | | 4/2015 | |
| WO | WO-2012101985 | A1 | * | 8/2012 | H05K 3/108 |

* cited by examiner

COIL ELECTRONIC COMPONENT

CROSS-REFERENCE TO RELATED APPLICATION

This application claims the benefit of priority to Korean Patent Application No. 10-2017-0175842 filed on Dec. 20, 2017 in the Korean Intellectual Property Office, the disclosure of which is incorporated herein by reference in its entirety.

BACKGROUND

1. Field

The present disclosure relates to a coil electronic component, and more particularly, to a thin film type power inductor having high inductance and a small size.

2. Description of Related Art

In accordance with miniaturization and high performance of an electronic product such as smartphone, notebook computer, tablet, smart watch, portable smart speaker, wireless portable projector, wireless smart camera, etc., electronic components mounted therein have been required to have a small size and high performance. Therefore, the development of a thin film type power inductor, advantageous for miniaturization, among power inductors, has been required.

SUMMARY

An aspect of the present disclosure may provide a coil electronic component in which a plating non-uniformity problem of a plurality of coil patterns is solved.

According to an aspect of the present disclosure, a coil electronic component may include a body; and external electrodes disposed on an external surface of the body. The body may include a support member including a through-hole, and upper and lower coils supported by the support member. The upper and lower coils may be connected to each other by a via, and the via may be formed on at least a portion of an edge of the through-hole of the support member.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Hereinafter, a coil electronic component according to an exemplary embodiment in the present disclosure will be described, but is not necessarily limited thereto.

Figure 1:
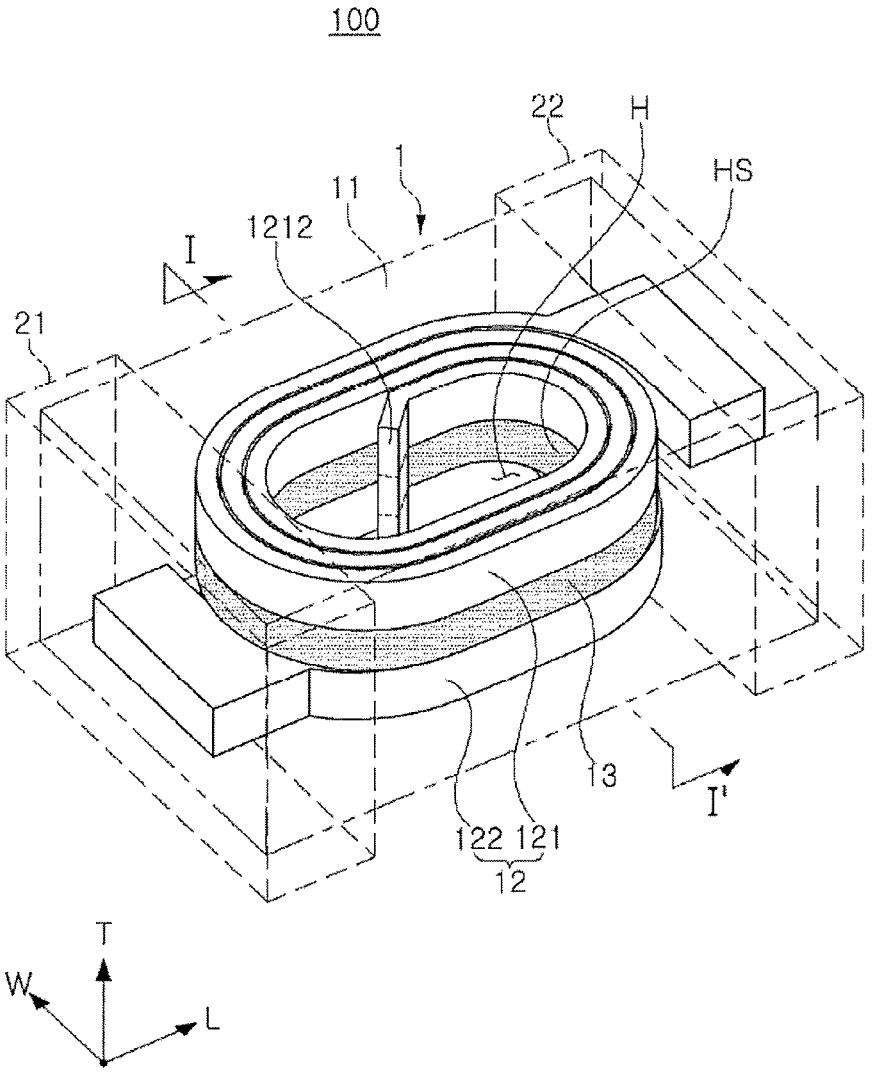
FIG. 1 is a perspective view of a coil electronic component according to an exemplary embodiment in the present disclosure.
Figure 2:
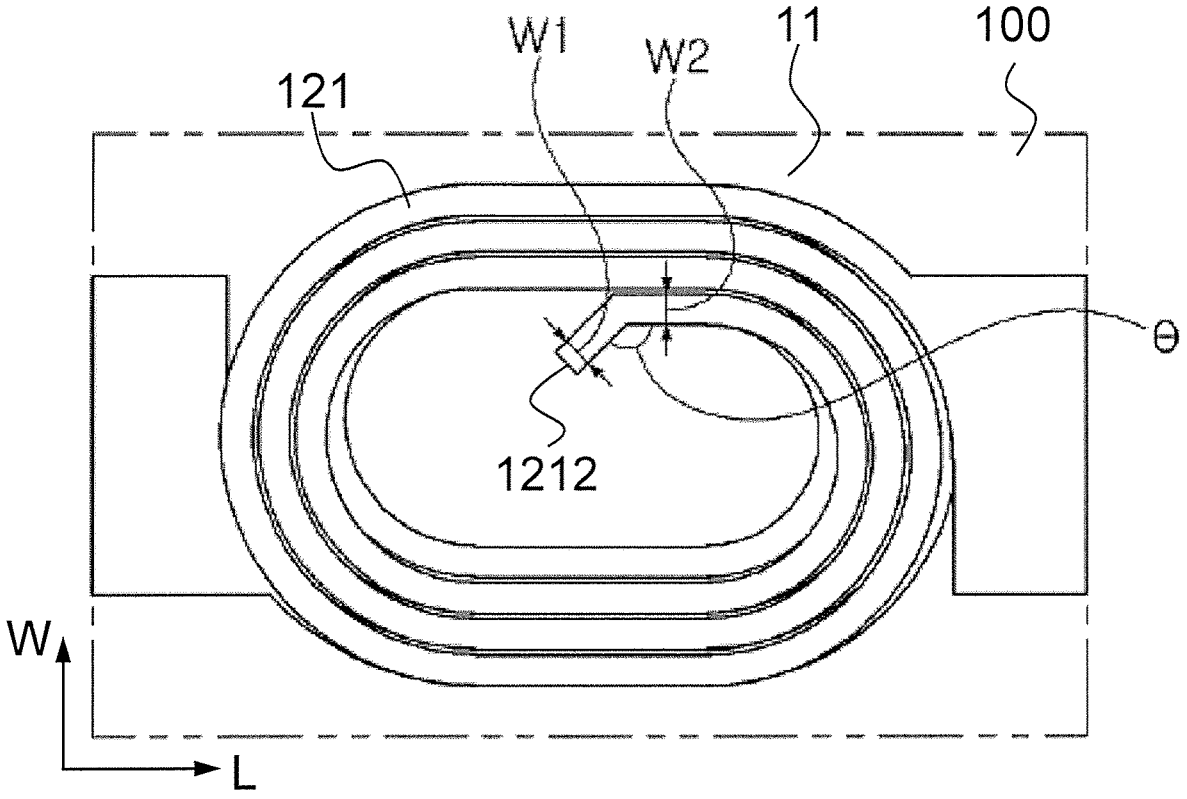
FIG. 2 is a plan view of FIG. 1 when viewed from the top.
Figure 3:
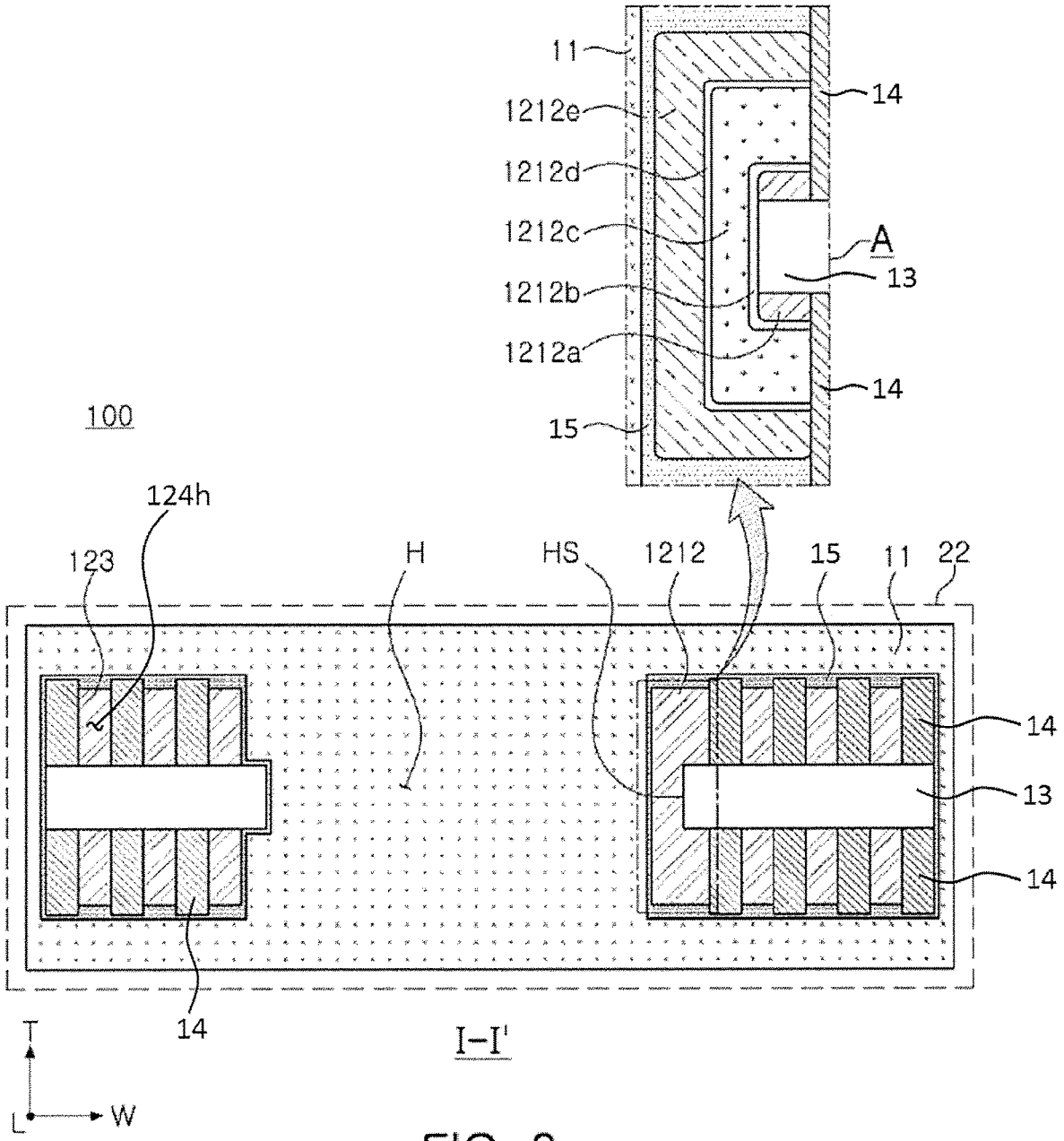
FIG. 3 is a cross-sectional view taken along line I-I' of FIG. 1.

FIG. 1 is a perspective view of a coil electronic component 100 according to an exemplary embodiment in the present disclosure, FIG. 2 is a plan view of an internal coil 12 of FIG. 1 when viewed from the top; and FIG. 3 is a cross-sectional view taken along line I-I' of FIG. 1.

Referring to FIGS. 1 through 3, the coil electronic component 100 may include a body 1 and external electrodes 21 and 22 disposed on an external surface of the body.

The body 1 may form an exterior of the coil electronic component, have upper and lower surfaces opposing each other in a thickness (T) direction, first and second end surfaces opposing each other in a length (L) direction, and first and second side surfaces opposing each other in a width (W) direction, and have a substantially hexahedral shape. However, an external shape of the body is not limited.

The body 1 may include a magnetic material 11. As the magnetic material, any material may be contained without limitation as long as it has magnetic properties. For example, the body may be formed by filling ferrite or a metal based soft magnetic material. An example of the ferrite may include ferrite known in the art such as Mn—Zn based ferrite, Ni—Zn based ferrite, Ni—Zn—Cu based ferrite, Mn—Mg based ferrite, Ba based ferrite, Li based ferrite, or the like. The metal based soft magnetic material may be an alloy containing at least one selected from the group consisting of Fe, Si, Cr, Al, and Ni. For example, the metal based soft magnetic material may contain Fe—Si—B—Cr based amorphous metal particles, but is not limited thereto. The metal based soft magnetic material may have a particle diameter of 0.1 μm or more to 20 μm or less and be contained in a form in which the metal based soft magnetic material is dispersed in a polymer such as an epoxy resin, polyimide, or the like.

An internal coil 12 may be encapsulated by the magnetic material 11, and include an upper coil 121 and a lower coil 122, wherein the upper and lower coils 121 and 122 may be supported by upper and lower surfaces of a support member 13, respectively.

First, the support member 13 will be described. As a material of the support member 13, any material may be used without limitation as long as it may insulate the upper and lower coils 121 and 122 from each other. As the material capable of insulating the upper and lower coils 121 and 122, a thermosetting resin such as an epoxy resin, a thermoplastic resin such as polyimide, or resins in which a reinforcement material, such as a glass fiber or an inorganic filler, is impregnated in the thermosetting resin and the thermoplastic resin, for example, a prepreg may be used. The material is not limited thereto.

The support member 13 may include a through-hole H penetrating from an upper surface of the support member 13 to a lower surface thereof, and the through-hole H may be filled with the magnetic material, thereby allowing a magnetic flux to flow smoothly and improving permeability. Further, an interface HS of the through-hole H may at least partially come in contact with a via 1212. The via 1212 may not penetrate through the support member 13. Also, the via 1212 may be formed in a via hole defined by surface of the interface HS and an insulating layer 15 that may be formed of the same material as the support member 13. In some embodiments of the present disclosure, the insulating layer 15 may be formed of a material different from that of the support member 13.

Since the via 1212 is formed using the interface HS of the through-hole H, there is no need to prepare a separate via hole in the vicinity of the through-hole H and penetrating through the support member 13. Since the separate via hole is not formed as described above, an area of the through-hole H of the support member 13 for accommodating magnetic materials may be significantly increased. As a result, permeability may be improved, and the magnetic flux generated in the internal coil 12 may smoothly flow.

A maximum line width W1 of the via 1212 on the interface HS of the through-hole H is not particularly limited, but may be substantially equal to an average line width of coil patterns 123 except for the via 1212. This means that over-plating of the via 1212 does not occur. The reason is that in a case of allowing the coil pattern 123 to have a fine line width, the line width of the via 1212 may be finely controlled at a similar level. The maximum line width W1 of the via 1212 may be at least 0.8 times to at most 1.2 times a line width W2 of a coil pattern 123 directly connected to the via 1212. In a case in which a uniform line width of the internal coil 12 is entirely maintained, the line width W2 of the coil pattern 123 directly connected to the via 1212 may be substantially the same as the average line width of the coil patterns 123. As described above, when a deviation of the maximum line width W1 of the via 1212 based on other coil patterns 123 except for the via 1212 is about 20%, deterioration of characteristics due to non-uniform growth of the coil patterns 123 may be prevented.

Referring to FIG. 2, the via 1212 may be formed to have a predetermined angle θ with respect to a winding direction of the coil pattern 123, wherein the predetermined angle may be less than 180°. Since the via 1212 has a structure in which the via 1212 is extended along the interface HS of the through-hole H of the support member 13, in order to allow the via 1212 to be connected from the upper coil 121 to the lower coil 122, the predetermined angle θ may be essentially formed. More preferably, the via 1212 may be led at a right angle 90° in the winding direction of the coil pattern 123. In this case, since a size of the via 1212 may be significantly decreased, and a filling rate of the magnetic material in the center of a core of the coil 12 may be significantly increased, this case may be advantageous in view of electrical characteristic values. Here, for process convenience, the angle θ at which the via 1212 is formed may be determined while patterning an opening pattern of an insulating wall 14 laminated on the support member 13. The insulating wall 14 may have a shape corresponding to a shape of the coil. The insulating wall 14 may be formed of the same material as the support member 13. In some embodiments of the present disclosure, the insulating wall 14 may be formed of a material different from that of the support member 13. In some embodiments, the insulating wall 14 contains a permanent type photosensitive insulating material.

In relation to this, a coil electronic component according to the related art is different from the coil electronic component 100 according to the present disclosure in that since a via 1212 is designed to have a structure in which a via hole having the via 1212 is formed in the vicinity of a through-hole H is separated from the through-hole instead of a structure in which a via is formed in an edge of the through-hole H, the via 1212 is formed in a winding direction of a coil pattern 123 along the via hole of a support member 13 as it is without separately changing the direction.

The via 1212 may have a stacking structure in which a plurality of conductive pattern layers 1212*a*-1212*e* are stacked, which will be described in more detail with reference to an enlarged view of part A of FIG. 3.

Referring to the enlarged view of part A of FIG. 3, the via 1212 may be at least composed of first to fifth conductive pattern layers 1212*a*, 1212*b*, 1212*c*, 1212*d*, and 1212*e*, respectively. Here, the via 1212 does not have to include all of the first to fifth conductive pattern layers 1212*a*-1212*e*, and may also include an additional conductive pattern layer (not shown) without limitation in addition to the conductive pattern layers 1212*a*-1212*e*. The additional conductive pattern layer may be added by those skilled in the art in order to increase an aspect ratio of the coil, and anisotropic plating and/or isotropic plating may be suitably combined in consideration of process conditions.

The via 1212 may include a first conductive pattern layer 1212*a* disposed in a lowermost layer while coming in contact with the upper or lower surface of the support member 13 among the plurality of conductive pattern layers 1212*a*-1212*e*. The first conductive pattern layer 1212*a* may be a copper (Cu) foil layer prepared in advance when the support member 13 is prepared. A thickness of the first conductive pattern layer 1212*a* is not particularly limited, but may be about 20 μm in consideration of a thickness of a general copper foil layer such as copper clad laminate (CCL). Further, the first conductive pattern layer 1212*a* may be a thin film layer formed using a separate sputtering method instead of the copper foil layer. In this case, various metals as well as metals capable of being used in a plating method such as molybdenum (Mo), nickel (Ni), and the like, may be selected, such that a degree of freedom in selecting the material may be increased.

The first conductive pattern layer 1212*a* may have a structure in which it does not come in contact with the interface HS of the through-hole H. Since the first conductive pattern layer 1212*a* is prepared simultaneously with preparing the support member 13, and the through-hole H is formed later, considering a process sequence, there is no possibility that the first conductive pattern layer 1212*a* is formed on the interface HS of the through-hole H. Although not specifically illustrated, the first conductive pattern layer 1212*a* may be formed in a structure entirely enclosing the upper and lower surfaces of the support member 13 and the interface HS of the through-hole H so that the first conductive pattern layer 1212*a* comes in contact with the interface HS of the through-hole H. In this case, the first conductive pattern layer 1212*a* may be formed using an electroless plating method.

Next, a second conductive pattern layer 1212*b* may be disposed on the first conductive pattern layer 1212*a*. A method of forming the second conductive pattern layer 1212*b* is not particularly limited. For example, the second conductive pattern layer 1212*b* may be formed by a chemical copper plating method. The second conductive pattern layer 1212*b* may be formed to enclose an upper surface of the first conductive pattern layer 1212*a* of the upper coil 121, and continuously enclose the interface HS of the through-hole H and an upper surface of the first conductive pattern layer 1212*a* of the lower coil 122. Substantially, the second conductive pattern layer 1212*b* may serve as a base pattern layer formed by the via 1212 penetrating through the inside of the through-hole H. A thickness of the second conductive pattern layer 1212*b* is not particularly limited, but since the second conductive pattern layer 1212*b* serves as the base pattern layer and is not a pattern layer for increasing an aspect ratio of the coil 12, there is no great need to form the second conductive pattern layer 1212*b* to be thick. For example, the second conductive pattern layer 1212*b* may have a thickness of 1 μm to 10 μm, but is not limited thereto.

Next, a third conductive pattern layer 1212*c* may be further formed to enclose the second conductive pattern layer 1212*b* using the second conductive pattern layer 1212*b* as the base pattern layer. The third conductive pattern layer 1212*c* may be formed by a method of patterning a dry film and then filling the patterned dry film. As a material of the third conductive pattern layer 1212*c*, any material may be used without limitation as long as it has excellent electrical conductivity. For example, the third conductive pattern layer 1212*c* may contain copper (Cu), nickel (Ni), or the like. The third conductive pattern layer 1212*c* may be formed to penetrate through the inside of the through-hole H similarly to the second conductive pattern layer 1212*b*.

Meanwhile, an edge of the via 1212 may be at least partially formed in a straight line shape. In a case of using a dry film as a guide for forming the via 1212, a shape of the edge of the via 1212 may be controlled to be a straight line. This means that over-plating of the via 1212 may be effectively prevented.

Next, a fourth conductive pattern layer 1212*d* being relatively thin as compared to the third conductive pattern layer 1212*c* may be formed on the third conductive pattern layer 1212*c*. This fourth conductive pattern layer 1212*d* may be considered as a kind of cap-plating layer. Further, an anisotropic plating layer substantially increasing the aspect ratio of the coil pattern 123 may be formed on the fourth conductive pattern layer 1212*d* as a fifth conductive pattern layer 1212*e*.

In the via 1212, since there is no need to form a via pad having a predetermined size or more, the line width of the via 1212 may be controlled at a level equal to or similar to the line width of the coil patterns 123 except for the via 1212. As a result, line width deviations and thickness deviations of the coil patterns 123 may be significantly decreased.

Meanwhile, a plurality of coil patterns 123 forming the upper and lower coils except for the via 1212 may be supported by the support member 13. The plurality of coil patterns 123 may be formed to be filled in an opening portion 124*h* of an insulating wall 14 supported by the support member 13. Since the plurality of coil patterns 123 grow using the insulating wall 14 as a kind of guide for plating growth, the line widths of the coil patterns 123 may be maintained to be substantially equal to each other, and a coil 12 having a high aspect ratio may be stably formed. A thickness of the coil pattern 123 filled in the opening portion 124*h* may be equal to or thinner than a thickness of the insulating wall 14. The reason is that this is advantageous in preventing a short-circuit between adjacent coil patterns 123. Further, in a case in which there is a step between the coil pattern 123 and the insulating wall 14, for example, a portion of the coil pattern 123 protrudes from the insulating wall 14 after the coil pattern 123 is filled in the opening portion 124*h*, the step may be removed by a predetermined polishing method.

Further, after all the coil pattern 123 and the insulating wall 14 are formed, an additional insulating layer 15 may be formed to enclose both the coil pattern 123 and the insulating wall 14 in order to insulate the coil pattern 123 and the magnetic material from each other. A method of forming the additional insulating layer 15 is not limited as long as the additional insulating layer 15 may serve to insulate the coil pattern 123 and the magnetic material from each other. More specifically, the insulating layer 15 may be formed by a chemical vapor deposition (CVD) method using an insulating resin, or formed by laminating an insulating sheet to cover only upper surfaces of the coil pattern 123 and the insulating wall 14. The insulating layer 15 may be formed of the same material as the insulating wall 14. In some embodiments of the present disclosure, the insulating layer 15 may be formed of a material different from that of the insulating wall 14.

An innermost coil pattern among the coil patterns 123 may be directly connected to the via 1212, such that an electrical current may flow from the innermost coil pattern of the upper coil 121 to an innermost coil pattern of the lower coil 122 through the via 1212.

Among inner and outer side surfaces of the innermost coil pattern, only the outer side surface of the innermost coil pattern may come in contact with the insulating wall 14. The reason is that when the insulating wall 14 does not exist toward the inner side surface of the innermost coil pattern, the amount of the magnetic material filled in the through-hole H may be increased, such that permeability may be increased. Meanwhile, a method of allowing the inner side surface of the innermost coil pattern not to come in contact with the insulating wall 14 is not limited, but in order to allow the innermost coil pattern to have substantially the same line width throughout in a plating direction similarly to other coil patterns 123, after completing formation of the innermost coil pattern while entirely maintaining the insulating wall 14 at both side surfaces of the innermost coil pattern, only the insulating wall 14 coming in contact with the inner side surface of the innermost coil pattern may be selectively removed. For example, a method of selectively removing a portion of the insulating wall 14 at the time of performing a cavity process for forming the through-hole H after completing formation of the internal coil 12 may be used. However, the method of removing the insulating wall 14 coming in contact with the inner side surface of the innermost coil pattern is not limited thereto.

As set forth above, according to exemplary embodiments in the present disclosure, the coil electronic component 100 capable of decreasing non-uniformity or misalignment of the coil patterns 123 to prevent deterioration of electrical characteristics and significantly increasing an area of the core to increase permeability may be provided.

While exemplary embodiments have been shown and described above, it will be apparent to those skilled in the art that modifications and variations could be made without departing from the scope of the present invention as defined by the appended claims.

What is claimed is:

1. A coil electronic component comprising:

a body including a support member including a through-hole, upper and lower coils supported by the support member and including a plurality of coil turns, a via connecting the upper and lower coils to each other, and an insulating wall supported by the support member and insulating adjacent coil turns from each other; and external electrodes disposed on an external surface of the body, wherein the via is disposed on at least a portion of an interface of the through-hole, wherein the body further includes an insulating layer surrounding the insulating wall and the support member, wherein the insulating layer is disposed on an outermost side surface of the support member, and wherein the via is in direct contact with the insulating wall and the insulating layer.

2. The coil electronic component of claim 1, wherein the via has a stacking structure in which a plurality of conductive pattern layers are stacked.

3. The coil electronic component of claim 2, wherein at least one of the plurality of conductive pattern layers extends along a portion of the interface of the through-hole, and a second conductive pattern layer, among the plurality of conductive pattern layers, extending along the portion of the interface continuously extends above and below upper and lower surfaces of the support member.

4. The coil electronic component of claim 3, wherein a first conductive pattern layer extending along the upper and lower surfaces of the support member continuously connected to the portion of the interface of the through-hole is a lowermost layer among the plurality of conductive pattern layers of the via.

5. The coil electronic component of claim 2, wherein a conductive pattern layer among the conductive pattern layers is disposed to penetrate through the inside of the through-hole.

6. The coil electronic component of claim 1, wherein the insulating wall and an adjacent insulating wall include an opening portion therebetween, and each of the plurality of coil turns is filled in the opening portion.

7. The coil electronic component of claim 1, wherein the insulating wall has a shape corresponding to a shape of the upper or lower coil, and wherein the insulating wall comes in contact with an outer side surface among inner and outer side surfaces of an innermost coil turn.

8. The coil electronic component of claim 1, wherein the insulating wall contains a permanent type photosensitive insulating material.

9. The coil electronic component of claim 1, wherein the through-hole is filled with a magnetic material.

10. The coil electronic component of claim 1, wherein another portion of the interface of the through-hole except for the portion of the interface on which the via is disposed comes in contact with an insulating layer or a magnetic material.

11. The coil electronic component of claim 1, wherein the upper and lower coils include a plurality of coil turns, and each of the plurality of coil turns includes a plurality of conductive pattern layers, wherein the plurality of conductive pattern layers include a first conductive pattern layer, coming in contact with an upper or lower surface of the support member, and a second conductive pattern layer, disposed to cover the first conductive pattern layer, and wherein a line width of the first conductive pattern layer is substantially equal to a line width of a portion of the second conductive pattern layer coming in contact with an upper surface of the first pattern conductive layer.

12. The coil electronic component of claim 1, wherein a maximum line width of the via is at least 0.8 times to at most 1.2 times a line width of a coil turn physically connected to the via.

13. The coil electronic component of claim 1, wherein at least a portion of an edge of a cross section of the via viewed from an upper surface of the body is a straight line.

14. The coil electronic component of claim 1, wherein the via is disposed at an angle θ of less than 180 degrees with respect to a winding direction of the coil turns of the upper or lower coil.

15. The coil electronic component of claim 1, wherein the via does not penetrate through the support member.

16. The coil electronic component of claim 1, wherein the via is laterally and partly covered by the support member and partly covered by the insulating layer.

17. The coil electronic component of claim 16, wherein the insulating layer and the insulating wall include the same material.

18. The coil electronic component of claim 16, wherein the insulating layer and the insulating wall include different materials.

19. The coil electronic component of claim 1, wherein a side surface of the via facing the through-hole is in direct contact with the insulating layer, and another side surface of the via facing the upper and lower coils is in direct contact with the insulating wall.

* * * * *